US006830493B2

(12) United States Patent
Koob

(10) Patent No.: US 6,830,493 B2
(45) Date of Patent: Dec. 14, 2004

(54) FLUSHING DEVICE

(75) Inventor: George F. Koob, Ellisville, MO (US)

(73) Assignee: George Koob, Ellisville, MO (US)

( * ) Notice: Subject to any disclaimer, the term of this patent is extended or adjusted under 35 U.S.C. 154(b) by 0 days.

(21) Appl. No.: 10/249,137

(22) Filed: Mar. 18, 2003

(65) Prior Publication Data

US 2004/0185726 A1 Sep. 23, 2004

(51) Int. Cl.[7] ..... B63H 21/10
(52) U.S. Cl. ..... 440/88 N
(58) Field of Search ..... 440/88 N, 88 R; 134/167 R; 114/145 A

(56) References Cited

U.S. PATENT DOCUMENTS 3,002,488 A * 10/1961 Guhlin ..... 440/113
4,589,851 A * 5/1986 Karls ..... 440/88 R
5,350,329 A * 9/1994 Haman ..... 440/88 R
5,423,703 A * 6/1995 Lorenzen ..... 440/88 R

* cited by examiner

*Primary Examiner*—Ed Swinehart
(74) *Attorney, Agent, or Firm*—Blackwell Sanders Peper Martin LLP

(57) ABSTRACT

The present invention provides a device for flushing a cavitation plate water intake outboard motor. The invention includes as coupling for attaching the device to a water source such as a hose, a flow passage for directing water through the device and into the outboard motor, and an attachment portion for attaching the device to the outboard motor.

1 Claim, 3 Drawing Sheets

FLUSHING DEVICE

BACKGROUND OF INVENTION

The present invention relates generally to a flushing device and, more specifically, to a device and method for flushing a cavitation plate water intake outboard motor.

Flushing is essential to proper maintenance of an outboard motor. During operation, mud, sand, and other unwanted materials may enter the motor intake. If the motor is used in salt water, salt residue accumulates within the motor. If the mud, sand, salt or other undesirable material is not flushed from the outboard motor, serious damage to the motor and/or the water pump may occur.

Numerous devices currently exist for flushing an outboard motor. These devices are, however, made for larger side-intake outboard motors. There is a need for a device for flushing smaller (about 3 to 15 horsepower) cavitation plate water intake outboard motors. Further, it is desirable to provide such a device constructed so that the outboard motor can be run in-gear while being flushed. This provides a number of advantages, including allowing the operator to test the drivetrain to the outboard motor propeller, as well as allowing tuning of the engine and other maintenance while the outboard motor is conveniently on land.

SUMMARY OF INVENTION

The present invention provides a flushing device that can be used for flushing anything that requires flushing as part of a normal maintenance regimen, such as a cavitation plate water intake of an outboard motor, or for any other reason. The device includes a water delivery portion and an attachment portion. In one embodiment, the water delivery portion of the present invention includes a coupling that can be attached to a water source, such as a hose, and a flow passage that directs water through the device and into the cavitation plate water intake outboard motor.

Further, in one embodiment of the present invention, the attachment portion includes a plate portion with an opening, the plate portion being attached to the flow passage such that the opening in the plate portion is aligned with the flow passage opening. Also included is at least one mount and at least one spacer located between the plate portion and the mount such that a U-shaped channel is formed between the plate portion and the mount. The device is attached to an outboard motor by sliding the device onto a perimeter lip of an outboard motor cavitation plate. The perimeter lip fits snugly within the U-shaped channel formed between the plate portion and the mount.

In a preferred embodiment of the present invention, two spacers and two mounts are used, one of each being located on each opposite side of the plate portion.

An alternative embodiment includes a flow valve in fluid communication with the coupling so that a user can control the flow of water from the water source to the outboard motor at the flushing device rather than at the source of the water itself.

DETAILED DESCRIPTION

For purposes of illustration, a flushing device constructed in accordance with the teachings of the present invention will be described in association with an outboard motor. It is understood that the present device may be used for any other suitable purpose.

Figure 1:
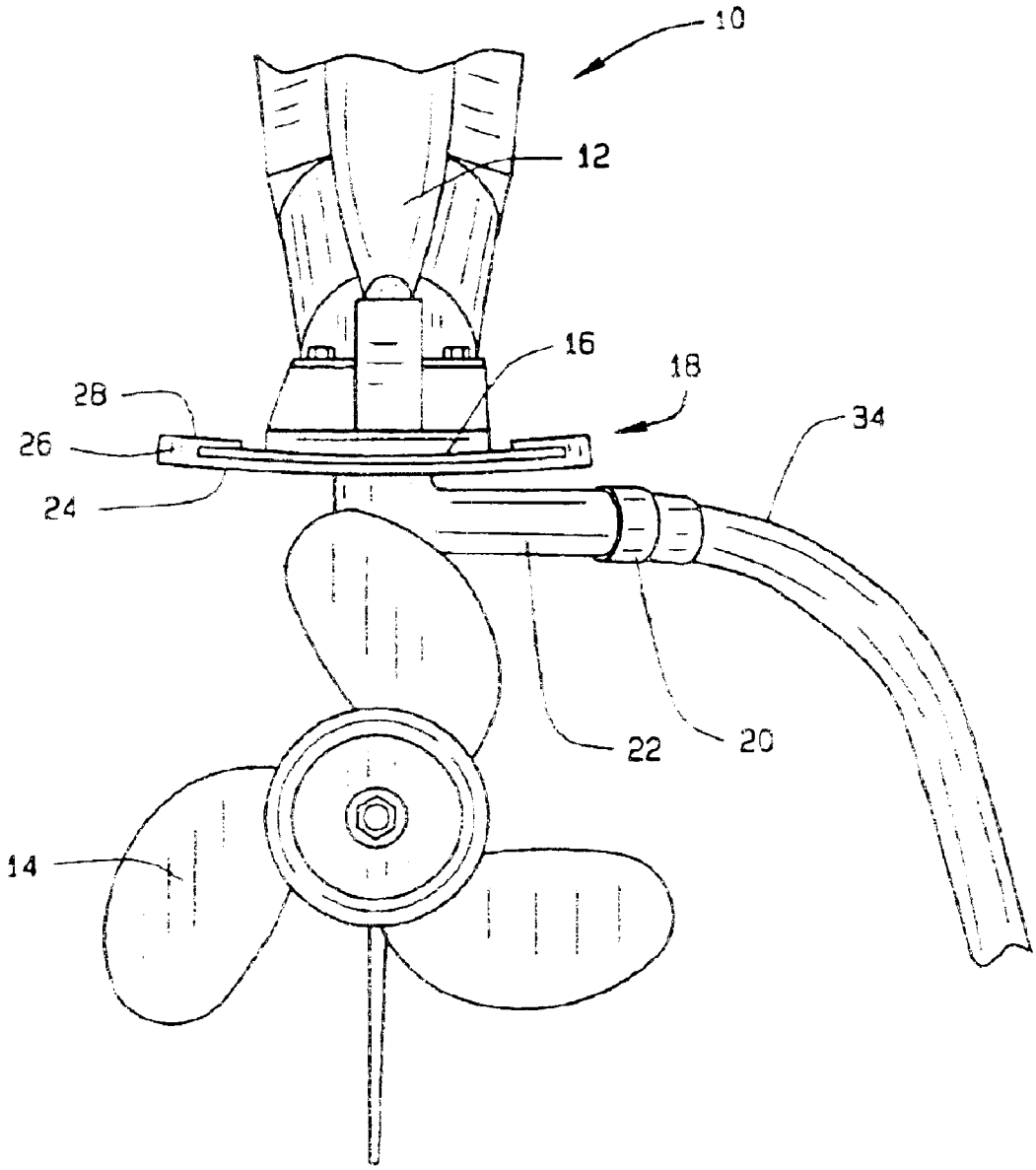
FIG. 1 is a perspective view of a cavitation plate water intake outboard motor having an embodiment of the flushing device of the present invention attached thereto.

Referring now to the drawings wherein like numeral represent like parts, FIG. 1 provides a perspective view of an outboard motor, indicated generally by the numeral 10, having a prop unit 12, a propeller 14, and a cavitation plate 16. An outboard motor flushing device constructed in accordance with the teachings of the present invention is indicated generally by the numeral 18. As shown most clearly in FIG. 3, device 18 includes a loose coupling 20, a flow passage 22 attached to loose coupling 20, and a plate portion 24 attached to flow passage 22. In the embodiment shown in FIG. 3, device 18 further includes two mountings 28 that are attached to plate portion 24 by spacers 26. As shown in FIG. 4, an opening 30 is provided in the bottom of plate portion 24 to allow water to be delivered through the device and into outboard motor 10.

Figure 3:
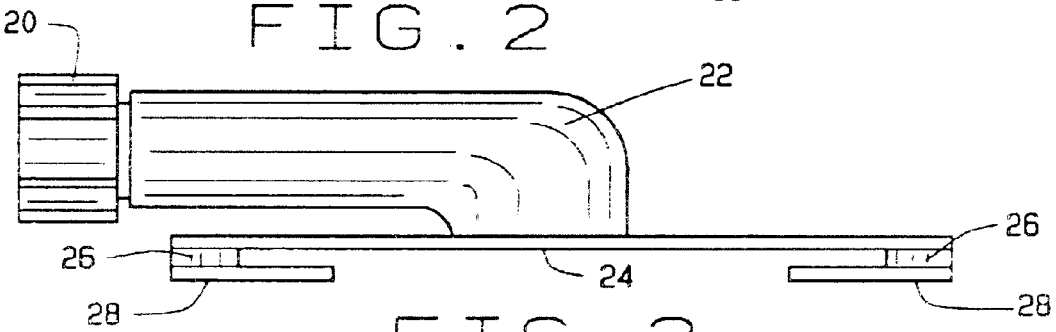
FIG. 3 is a perspective view of an embodiment of the flushing device of the present invention.
Figure 4:
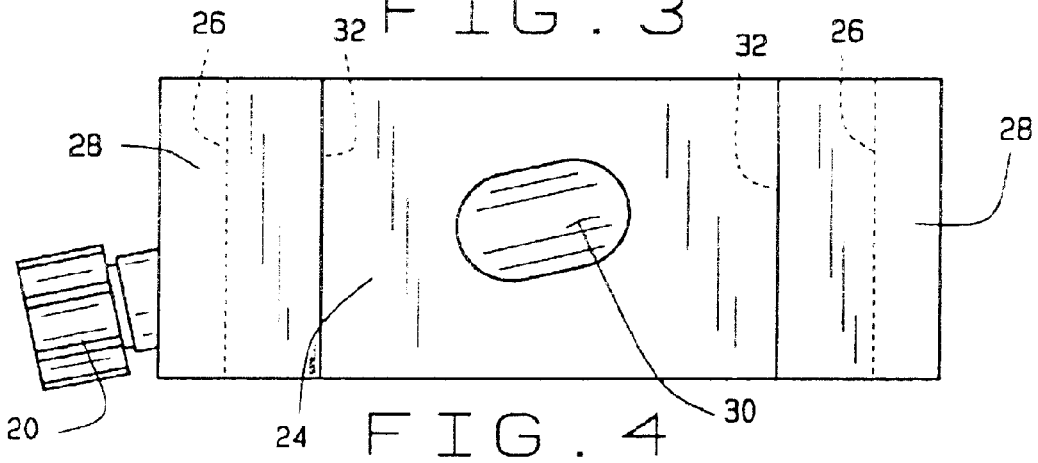
FIG. 4 is a bottom view of an embodiment of the flushing device of the present invention.

Device 18 is shown in more detail in FIGS. 3 and 4. Loose coupling 20 is hollow and threaded such that an ordinary garden hose can be attached thereto. It is to be understood that any other suitable means of attaching a garden hose or other water source to device 18 may be used in place of loose coupling 20. For example, coupling 20 may be fixed rather than loose. Flow passage 22 has opposite open ends and serves to direct water-entering device 18 from hose 34 and through loose coupling 20 into outboard motor 10. Flow passage 22 is attached to plate portion 24 such that the hollow interior of flow passage 22 is substantially in alignment with opening 30 in plate portion 24. Coupling 20 and flow passage 22 combine to form a water delivery portion of the present device. Flow passage 22 may have any geometric shape, including but not limited to a cylindrical tube, a rectangular tube, or a triangular tube.

Flow passage 22 and plate portion 24 are preferably constructed from PVC or similar material and may be formed as a unitary whole rather than as separate pieces. Any suitable material may be used for the construction of flow passage 22 and plate portion 24. For example, instead of PVC, one could construct the present device from ABS polypropylene, a lightweight metal such as aluminum, or any other suitable material. Flow passage 22 is disposed such that when hose 34 is attached to loose coupling 20, hose 34 is held clear of propeller 14. Further, device 10 matches the angle of the motor's intake grate, allowing for more efficient flushing.

FIGS. 3 and 4 also show, in more detail, spacers 26 and mounts 28. Spacers 26 are fixedly attached to plate portion 24 and are preferably of a thickness such that the perimeter lip 16*a* of cavitation plate 16 of outboard motor 10 can slide easily between plate portion 24 and mounts 26 and be held snugly there between. In a preferred embodiment of the present invention, spacers 26 are constructed such that the interior walls 32 of spacers 26 are slanted to form tapered U-shaped channels that accommodate the shape of the perimeter lip 16*a* of cavitation plate 16. In an alternative embodiment, however, interior walls 32 of spacers 26 are not slanted. Although slanted walls provide a more snug fit to any given cavitation plate, unslanted walls allow greater flexibility in fitting one device 10 to multiple cavitation plates. Mounts 28 are fixedly attached to spacers 26 such that they slide over the top of perimeter lip 16*a* of cavitation plate 16, with perimeter lip 16*a* being inserted into the U-shaped channels, thereby holding device 18 securely onto cavitation plate 16. Plate portion 24, spacers 26, and mounts 28 combine to form an attachment portion of the present device. Opening 30 is provided in plate portion 24 to deliver water from device 10 to an outbound motor or other device requiring flushing. In an alternative embodiment of the present invention, plate portion 24 or opening 30 may be provided with an o-ring or gasket 36, or other sealing member to form a seal between device 10 and the underside of cavitation plate 16.

Figure 5:
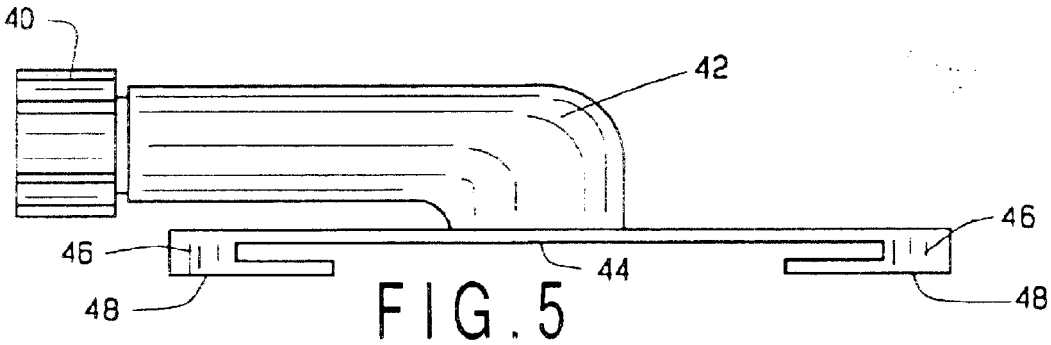
FIG. 5 is a side view of an embodiment of the present invention wherein the attachment portion is made from a single, uninterrupted piece of material.
Figure 6:
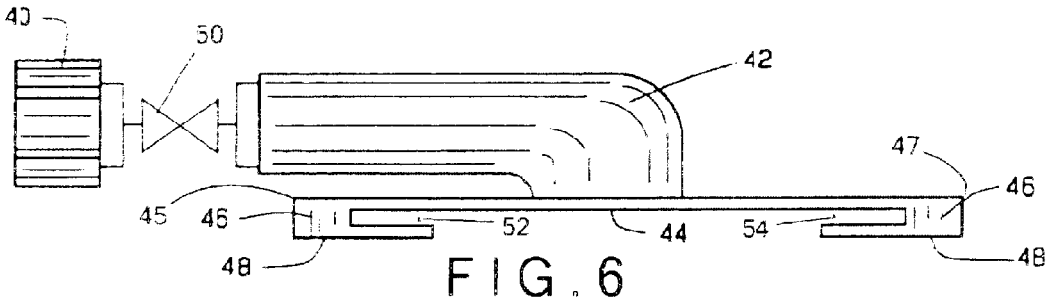
FIG. 6 is a side view of an embodiment of the present invention wherein the attachment portion is made from a single, uninterrupted piece of material and wherein said embodiment includes a valve positioned between the loose coupling and the flow passage thereof.

FIGS. 5 and 6 show an embodiment of the present invention wherein the attachment portion of the present device is constructed from a single, uninterrupted piece of material. The attachment portion includes plate portion 44, having two side edge portions 45 and 47 at opposite ends thereof. Extending from the side edge portions are spacer portions 46. In this embodiment of the present invention, spacer portions 46 are not constructed from a piece of material separate from plate portion 44 (as is the case with spacers 26 in FIG. 3). Rather, the entire attachment portion is a single piece of material. Likewise, mount portions 48 extend inward from spacer portions 46, creating U-shaped channels 52 and 54 between mount portions 48 and plate portion 44 so that the device can be attached to a cavitation plate.

FIG. 6 also shows a valve 50 located between loose coupling 40 and flow passage 42 so that the user of the device of the present invention can control the flow of water through the device at the location of the device itself rather than at the water source. Such a valve could be used with any embodiment of the present invention.

Figure 2:
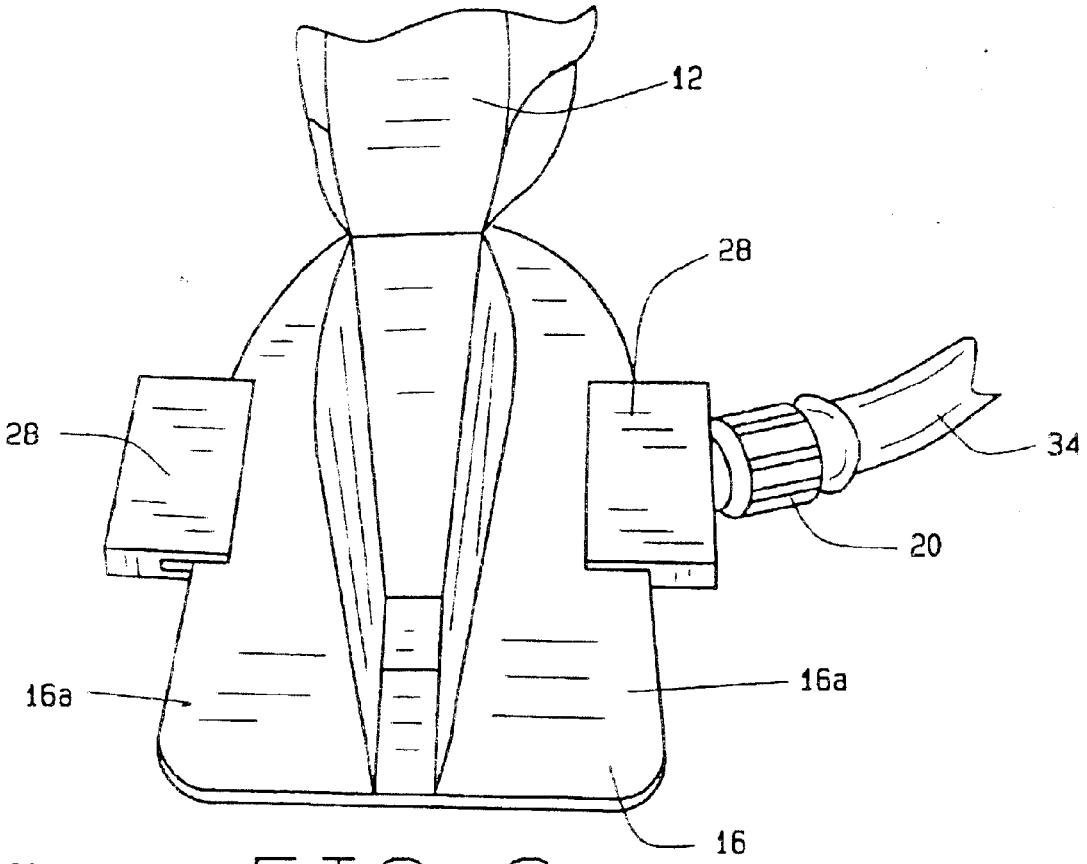
FIG. 2 is a perspective view of a cavitation plate of a cavitation plate water intake outboard motor having an embodiment of the flushing device of the present invention attached thereto.

In use, device 18 is attached to cavitation plate 16 of outboard motor 10, as best shown in FIG. 2. In one embodiment of the present invention, mountings 28 used to attach device 18 to cavitation plate 16 are formed from generally rectangular plate-like materials that are fixedly attached to plate portion via spacers 26, forming a generally U-shaped channel there between. It is contemplated that any suitable method of attaching the present device to cavitation plate 16 of outboard motor 10 can be used. Once device 18 is in place, a hose 34 is attached to loose coupling 20. Water is delivered to device 18 via hose 34, and into the intake of outboard motor 10 via opening 30 in plate portion 24. Because hose 34 is held free of propeller 14, the drivetrain to propeller 14 can be engaged while outboard motor 10 is being flushed. This means that outboard motor 10 can be run in-gear during the flushing procedure. This provides a number of maintenance benefits since the motor can be run in-gear while on dry land.

It is contemplated that additions or modifications can be made to the present device without departing from the scope of the present invention. For instance, although specific materials are used in a preferred embodiment of the present invention, any suitable materials may be used in the construction of any of the components of the present invention. It is further contemplated that a valve may be added between loose coupling 20 and flow passage 22 such that water flow into device 18 can be controlled at the device itself rather than at the source of the water. The specific details of the invention described herein, which are given by way of example only, may be altered without departing from the spirit or scope of the invention as defined in the claims.

What is claimed is:

1. A device for flushing a cavitation plate motor intake outboard motor comprising:

an attachment portion comprising:

a plate portion;

a first spacer portion depending from a first side edge of said plate portion and having an interior wall;

a second spacer portion depending from an opposite side edge of said plate portion and having an interior wall;

a first mount portion depending from said first spacer portion and forming a U-shaped channel between said plate portion and said first mount portion;

a second mount portion depending from said second spacer portion and forming a U-shaped channel between said plate portion and said second mount portion;

wherein said attachment portion is constructed from a single, uninterrupted material; and a water delivery portion for connecting said device to a water source and providing water to an intake of said cavitation plate intake outboard motor, said water delivery portion being angled such that said device for flushing a cavitation plate intake outboard motor may be used while said outboard motor is in gear and a propeller of said outboard motor remains attached to said outboard motor.

* * * * *